US006039626A

United States Patent [19]

Gerold et al.

[11] Patent Number: 6,039,626

[45] Date of Patent: Mar. 21, 2000

[54] VOICE-ACTIVATED TOY TRUCK WITH ANIMATED FEATURES

[76] Inventors: Gregory L. Gerold, 2623 Mt. Airy Ave., Cincinnati, Ohio 45239; Mark R. Wiesenhahn, 270 Morris Ave., Providence, R.I. 02906

[21] Appl. No.: 09/151,717

[22] Filed: Sep. 11, 1998

[51] Int. Cl.[7] ..... A63H 30/00

[52] U.S. Cl. ..... 446/175; 446/268; 446/280

[58] Field of Search ..... 446/71, 72, 268, 446/271, 280, 292, 337, 365, 372, 431, 437, 486, 175

[56] References Cited

U.S. PATENT DOCUMENTS

| | | | |
|---|---|---|---|
| 3,792,550 | 2/1974 | Crawford | 446/280 |
| 3,815,931 | 6/1974 | Morrison et al. | 446/280 |
| 3,828,469 | 8/1974 | Giroud | 446/337 |
| 4,219,962 | 9/1980 | Dankman et al. | 46/232 |
| 4,475,618 | 10/1984 | Kennedy et al. | 180/237 |
| 4,582,499 | 4/1986 | Saigo et al. | 446/372 |
| 4,588,386 | 5/1986 | Kennedy et al. | 446/6 |
| 4,662,856 | 5/1987 | Getgey et al. | 446/280 |
| 4,693,693 | 9/1987 | Kennedy et al. | 446/6 |
| 4,762,511 | 8/1988 | Lee et al. | 446/6 |
| 4,846,758 | 7/1989 | Chou | 446/437 |
| 4,913,676 | 4/1990 | Koguchi et al. | 446/300 |
| 4,946,416 | 8/1990 | Stern et al. | 446/409 |
| 5,045,016 | 9/1991 | Stern et al. | 446/409 |
| 5,134,796 | 8/1992 | Satoh et al. | 40/414 |
| 5,173,072 | 12/1992 | Ozawa | 446/462 |
| 5,209,695 | 5/1993 | Rothschild | 446/175 |
| 5,273,478 | 12/1993 | Yamasaki | 446/409 |
| 5,306,197 | 4/1994 | Watanabe | 446/409 |
| 5,324,225 | 6/1994 | Satoh et al. | 446/175 |
| 5,356,326 | 10/1994 | Ting | 446/175 |
| 5,407,376 | 4/1995 | Avital et al. | 446/175 |
| 5,584,741 | 12/1996 | Cheung | 446/337 |
| 5,609,510 | 3/1997 | Stubenfoll et al. | 446/437 X |
| 5,647,787 | 7/1997 | Raviv et al. | 446/175 |
| 5,699,869 | 12/1997 | Fritzinger et al. | 180/65.5 |
| 5,785,576 | 7/1998 | Belton | 446/486 |
| 5,908,344 | 6/1999 | Kociemba | 446/280 |

*Primary Examiner*—Sam Rimell

*Attorney, Agent, or Firm*—Marshall, O'Toole, Gerstein, Murray & Borun

[57] ABSTRACT

A voice activated toy truck having animated features includes a truck chassis that supports a hood and cab that readily flexes and bends and that may have an exterior surface molded in the shape of a set of facial features. The truck chassis supports a truck bed carrier that supports a truck bed. The truck bed is mounted to the carrier in a movable fashion such that the truck bed is capable of movement in a side-side fashion relative to the truck chassis. A first actuator assembly causes the flexible hood to flex thereby causing the facial features to move and a second actuator assembly causes the truck bed to move in the side-to-side fashion that emulates a puppy dog wagging its tail. A sound detecting circuit actuates a control circuit that is coupled to the first and second actuator assemblies and that causes the first and second assemblies to operate in the manner described.

19 Claims, 14 Drawing Sheets

VOICE-ACTIVATED TOY TRUCK WITH ANIMATED FEATURES

BACKGROUND OF THE INVENTION

The present invention relates to a voice-activated toy truck having animated features that move in response to a child's voice.

Toys that operate in response to a child's voice or to any other sound are well known in the art. For example, U.S. Pat. No. 5,324,225 to Satoh discloses a toy figure that is externally configured to look like a cat and that has circuitry for detecting voice signals and for detecting pressure caused by touching the toy cat in a manner akin to petting. In response to the voice and pressure signals the cat simulates the characteristic movements and sounds of a live cat by purring and wagging its tail.

Another example of a voice-actuated toy is provided in U.S. Pat. No. 5,647,787 which discloses a sound controlled dinosaur-type monster toy that may be programmed to perform a series of movements in response to a set of voice issued commands.

Lastly, U.S. Pat. No. 5,209,695 discloses a sound controlled apparatus for insertion into a toy robot. The apparatus includes a microprocessor for receiving and processing sound commands which are then used to drive the control apparatus in a manner that emulates robot-like movement.

SUMMARY OF THE INVENTION

In one aspect, the present invention is directed to a voice activated toy truck having animated features. In particular, the truck includes a truck chassis that supports a hood and cab that readily flexes and bends. The truck chassis is mounted to a set of four wheels and also supports a truck bed carrier. A truck bed is mounted to the carrier in a movable fashion such that the truck bed is capable of movement in a side-to-side fashion relative to the truck chassis. The truck further includes a first actuator assembly that causes the flexible hood to flex and a second actuator assembly that causes the truck bed to move in the side-to-side fashion. A sound detecting circuit adapted to detect sound provides actuating signals to a control circuit that is coupled to the first and second actuator assemblies and that causes the assemblies to operate in the manner described.

In another aspect of the present invention, the readily flexible hood has an exterior surface that is molded to have the shape of facial features such that when the actuator assembly causes the hood to bend, the facial features flex.

In still another aspect of the present invention, the voice activated toy truck further includes a sound generating device, such as a speaker, that generates a set of predetermined phrases and sound effects in response to the sound detecting circuit detecting sound.

In yet another aspect of the present invention, the control circuit actuates the sound generating device and causes the facial features to flex simultaneously thereby causing the toy truck to appear to be speaking.

In still another aspect of the present invention, the voice activated toy truck further includes a plurality of switches disposed at various locations about the truck chassis. The control circuit is responsive to the switches and causes the first and second actuator assemblies to operate in response to the switches thereby causing the flexible hood to bend and the truck bed to move in a side to side fashion.

In yet another aspect of the present invention, one of the switches is disposed on a support element that is mounted to the truck chassis and is disposed beneath and extends through a first opening in the flexible hood. A helmet is attached to the support member with a pivot pin and positioned such that the switch is concealed when the helmet is in a non-pivoted position and is revealed when the helmet is in a pivoted position.

In another aspect of the present invention, one of the plurality of switches comprises a push-button switch that is mounted on the truck chassis and is located in a concealed manner beneath a portion of the flexible hood. The push-button switch is actuated by depressing the portion of the flexible hood.

In yet another aspect of the present invention, the voice activated toy truck comprises a truck chassis and a movable structure associated with the truck chassis adapted to generate an animated response. In addition, an actuator assembly that is coupled to the truck chassis activates the movable structure adapted to generate an animated response. A sound detecting circuit detects sound and provides actuating signals to a control circuit that drives the actuator assembly in response to the detected sound.

DETAILED DESCRIPTION OF THE PREFERRED EMBODIMENTS

Figure 1:
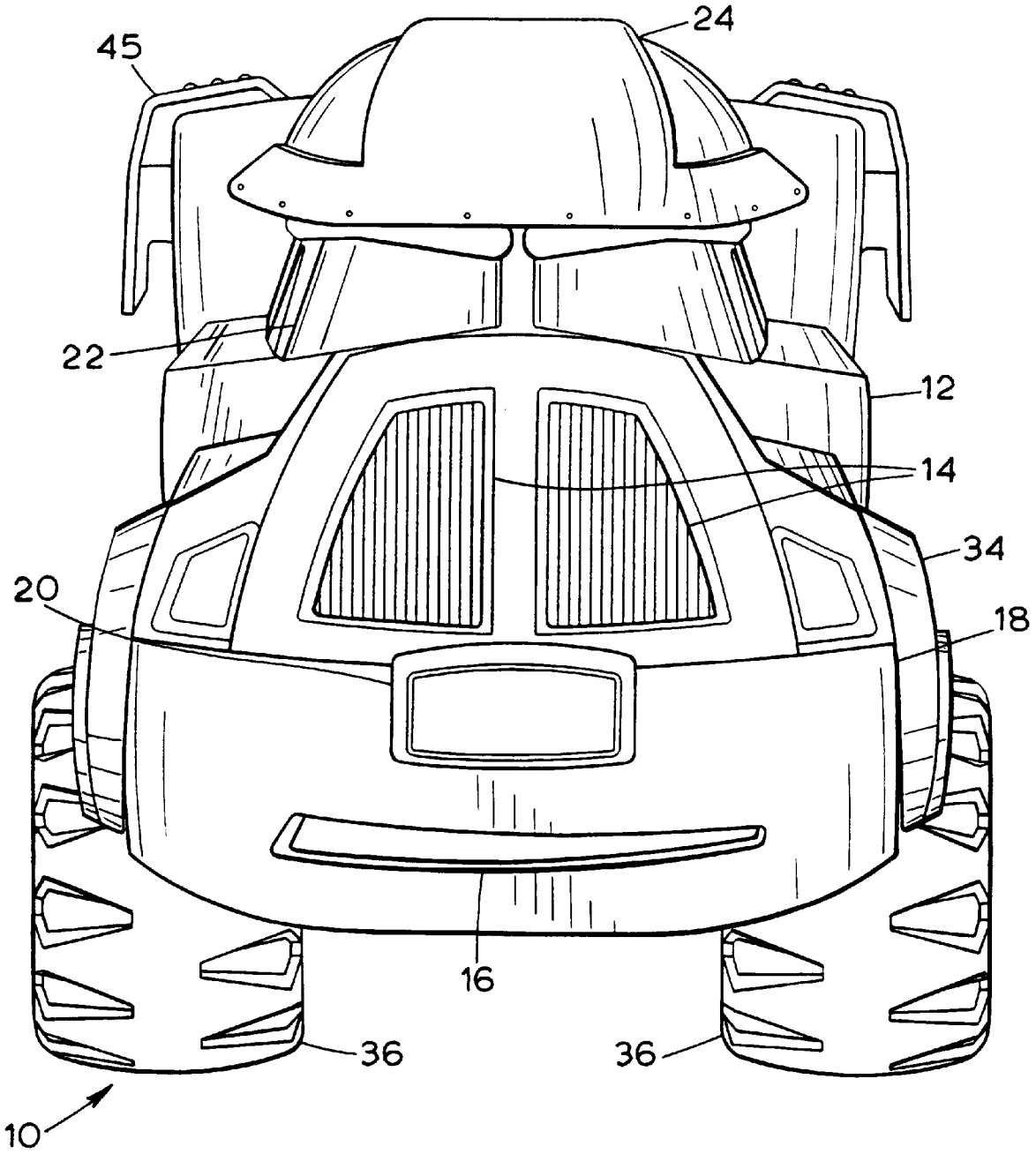
FIG. 1 is a front view of a toy truck constructed in accordance with the preferred embodiment of the present invention.
Figure 2:
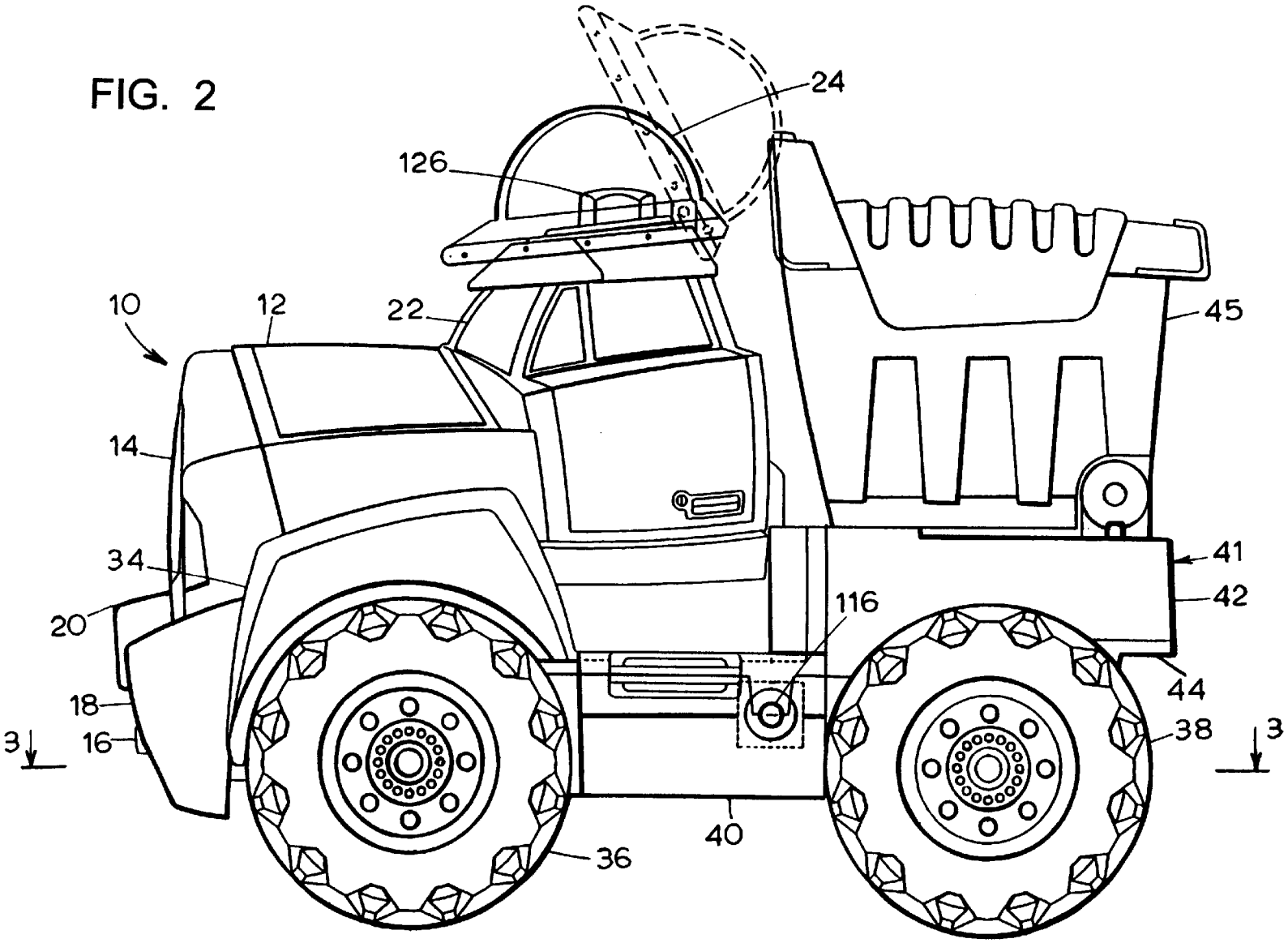
FIG. 2 is a side view of the toy truck shown in FIG. 1.

Referring to FIG. 1 which provides the front view of the preferred embodiment of a voice activated toy truck with animated features constructed in accordance with the present invention and to FIG. 2 that provides a side view of the toy, a toy dump truck 10 includes a hood and cab 12 comprising a unitary sheet of molded, flexible plastic that may be constructed of, for example, polyvinyl chloride. The flexible hood and cab 12 is molded to form a set of grill panels 14, a recessed portion 16 having a slightly curved but generally rectangular shape residing on a bumper 18, a protruding rectangular member 20 that is centrally disposed between the grill panels 14 and the bumper 18 and a windshield 22. When viewed together these features resemble a human face whereby the recessed portion 16 is a mouth, the protruding rectangular member 20 is a nose, and the windshield 22 is a set of eyes. To enhance the facial features, a helmet 24 is disposed on top of the flexible hood and cab 12.

Fenders 34 constructed of a non-flexible plastic such as, for example, polypropylene, extend from and are attached to each side of the flexible hood and cab 12. Front and rear wheels 36 and 38 are constructed of a soft flexible plastic like that used for the flexible hood and cab 12.

Referring now to FIG. 2, the fenders 34 are cooperatively disposed around, but do not contact the front wheels 36 and further extend to form the upper portion of a gas tank 40. The truck body 41 comprising an upper chassis 42 and a lower chassis 44 is cooperatively disposed to form a cavity 46 (see FIG. 3) therein. A portion of the lower chassis 44 is molded to form a lower portion of the gas tank 40. A truck bed 45 is disposed on the truck body 41 behind the flexible hood and cab 12.

Figure 3:
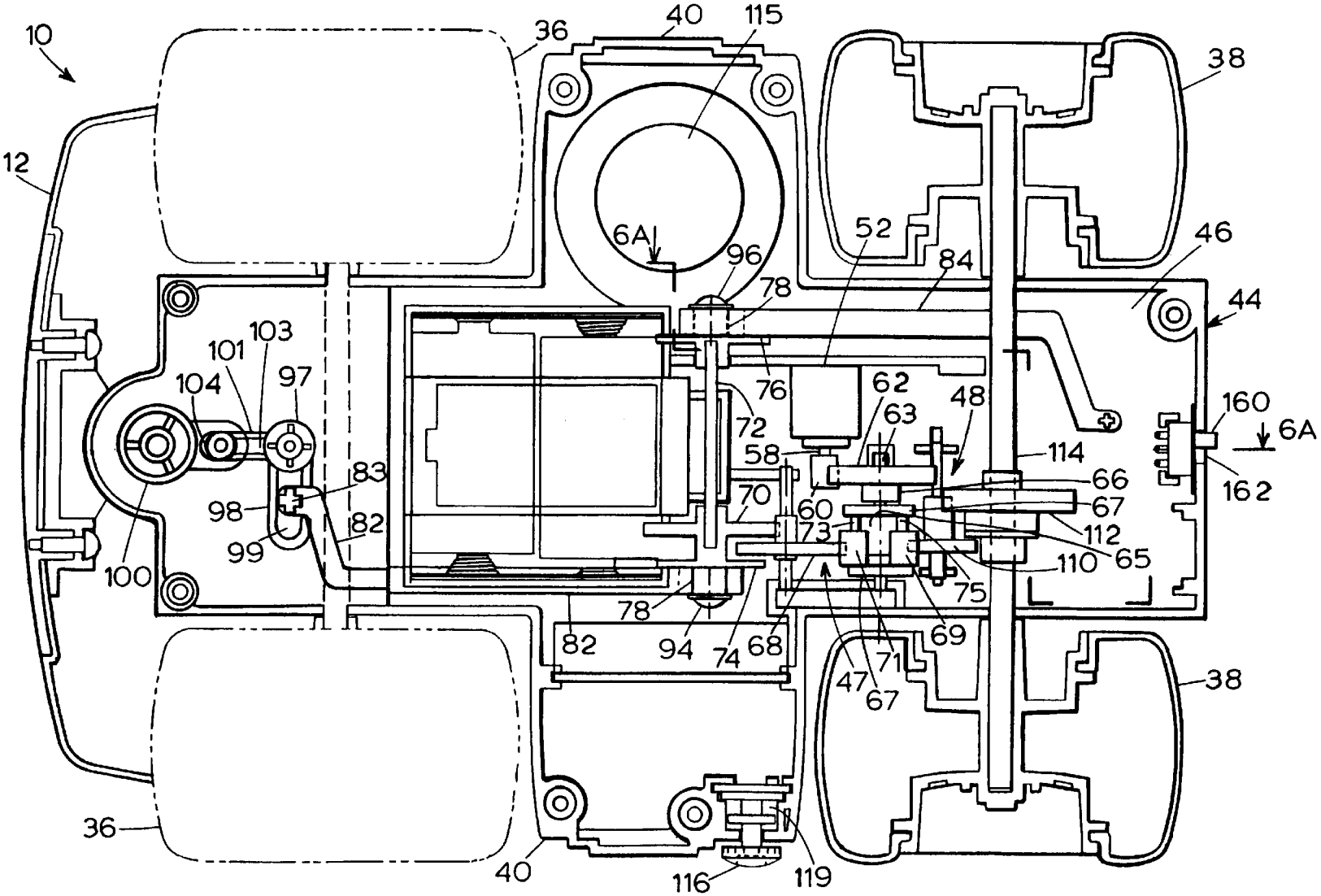
FIG. 3 is a section view of the toy truck as viewed along lines 3—3 shown in FIG. 2 that includes an animated feature actuator assembly and a wheel-drive gear assembly.

Referring now to FIG. 3, which is a sectional view of the voice activated toy truck 10, the toy truck 10 has an animated feature actuator assembly 47 that operates to effect two animated features or responses. In particular, the animated feature actuator assembly 47 causes the hood portion of the flexible hood and cab 12 to deform and thereby change shape in a manner that causes the nose 20 to wrinkle and the mouth 16 to flex, thereby bringing the facial features to life. While moving the facial features 16 and 20, the animated feature actuator assembly 47 simultaneously causes the truck bed 45 to move from side to side in a lateral rocking motion that emulates, for example, a puppy dog wagging its tail.

In addition, the toy truck 10 has a wheel-drive gear assembly 48 that drives the rear wheels forward. A motor 52, when rotating in a forward direction engages and drives the wheel-drive gear assembly 48 and, when rotating in reverse, engages and drives the animated feature actuator assembly 47.

Figure 4B:
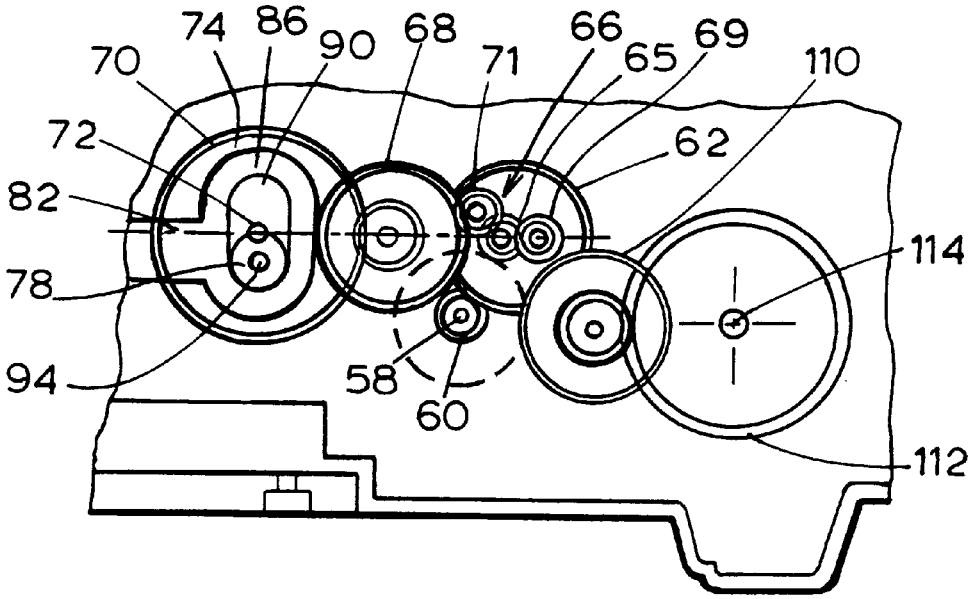
FIG. 4B is a side view of the animated feature actuator assembly and the wheel-drive gear assembly shown in FIG. 3 with the planetary gear 66 occupying a second position.
Figure 4A:
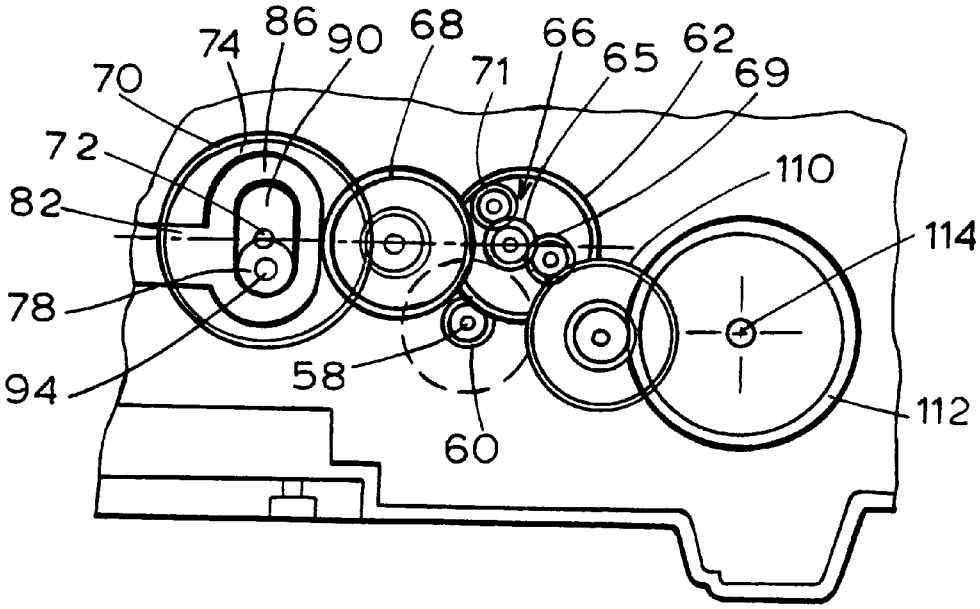
FIG. 4A is a side view of the animated feature actuator assembly and the wheel-drive gear assembly shown in FIG. 3 with a planetary gear 66 occupying a first position.

Referring now to FIGS. 3 and 4A, to drive both assemblies 47 and 48, a gear 60 is disposed on a shaft 58 that is disposed on and driven by the motor 52. Gear 60 interlocks with a gear 62, which is radially disposed in a fixed manner on a rotatable shaft 63. A planetary gear 66 is also radially disposed on the shaft 63 such that rotation of gear 62 causes rotation of the planetary gear 66. The planetary gear 66 comprises a central gear 65 radially disposed in a fixed manner on the shaft 63, and a pivoting element 67, also radially disposed on shaft 63, and having two shafts 73, 75 on which gears 71 and 69 are radially disposed; respectively. Thus, rotation of the gear 60 causes rotation of gear 62, shaft 63, and the centrally disposed gear 65. The rotation of shaft 63, in turn, causes pivoting element 67 to pivot between two positions.

When the planetary gear 66 occupies a first position, shown in FIG. 4A, it engages the wheel-drive gear assembly 48. To move gear 66 into the first position, the motor 52 is rotated in a forward direction thereby causing shaft 58 and gear 60 to rotate in a counter-clockwise direction. The counter-clockwise rotation of shaft 58 and gear 60 causes the gear 62 and shaft 63 to rotate in a clockwise direction. In addition, provided that gear 69 has not yet engaged a gear 110 of the wheel-drive gear assembly, pivot element 67 also rotates in a clockwise direction causing gear 69 to engage the gear 110 of the wheel-drive gear assembly. When the gear 69 engages the gear 110, the pivoting motion of pivot element 67 comes to a halt in the first position, and the gear 69 proceeds to drive the gear 110.

To effect gear driven movement of the rear wheels 38, the gear 110, in turn, drives a gear 112. Gear 112 is radially disposed on and rotates in unison with a rear axle 114. Rotation of the rear axle 114 propels the rear wheels 38 forward causing the toy truck 10 to travel in a forward direction. Thus, rotating the motor 52 in a forward direction causes actuation of the wheel-drive gear assembly 48.

Referring now to FIGS. 3 and 4B, when the planetary gear 66 occupies a second position, shown in FIG. 4B, it engages the animated feature actuator assembly 47. To move gear 66 into the second position, the motor 52 is rotated in a reverse direction thereby causing shaft 58 and gear 60 to rotate in a clockwise fashion. The clockwise rotation of shaft 58 and gear 60 causes the gear 62 and shaft 63 to rotate in a counter-clockwise direction. In addition, provided that gear 71 has not yet engaged a gear 68 of the animated feature actuator assembly 47, pivot element 67 also rotates in a counter-clockwise direction causing gear 71 to engage the gear 68 of the animated feature actuator assembly 47. When the gear 71 engages the gear 68, the pivoting motion of pivot element 67 comes to a halt in the second position, and gear 71 proceeds to drive the gear 68.

The gear 68, in turn, drives a gear 70. Gear 70 is radially disposed on a shaft 72 such that shaft 72 and gear 70 rotate in unison. Disks 74 and 76 are disposed on the ends of shaft 72 and each has a rod-shaped connecting element 78 that is offset from the centers of and extend outwardly from the faces of disks 74 and 76. Cams 82 and 84 each include a vertical portion 86 that has a hollowed out section 90 that receives the connecting element 78. Fasteners 94 and 96 disposed on the end of the actuators 78 are used to fasten the cams 82 and 84 to the rotating disks 74 and 76. When the gear shaft 72 rotates thereby causing the disks 74 and 76 to rotate, connecting elements 78 cause the cams 82 and 84, to move in a locomotive-like manner. Thus, driving the motor in a reverse direction causes actuation of the animated feature actuator assembly 47.

Referring still to FIG. 3, to effect the facial movement, the cam 82 engages a linking element 97. The linking element 97 includes an arm 98 having a slot 99 for receiving a stem 83 that extends vertically from the cam 82. Linking element 97 further includes an arm 101 having a slot 103. The slot 103 is cooperatively aligned with a slot 104 of a mouth plate 100. A link 92 connects slot 103 to slot 104 such that movement of arm 101 causes movement of the mouthplate 100. Movement of cam 82 thereby causes rotation of linking element 97 which, in turn, causes the mouth plate 100 to pivot. The mouth plate 100 is adjacent and attached to the flexible hood and cab 12 so that the pivoting movement of the mouth plate 100 causes the mouth 16 and nose 20 to flex and wrinkle.

Figure 5:
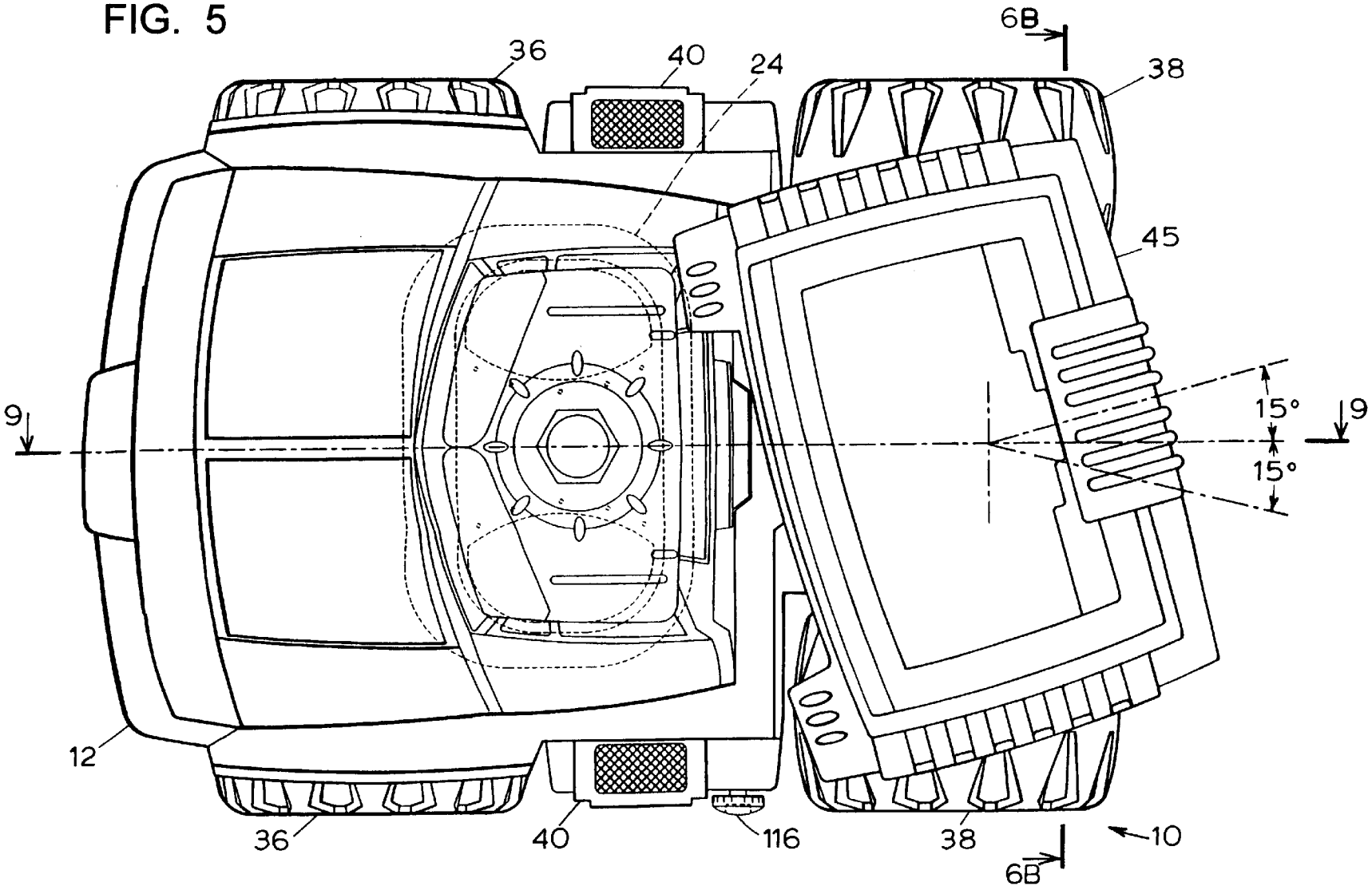
FIG. 5 is a top view of the toy truck of FIG. 1.
Figure 6A:
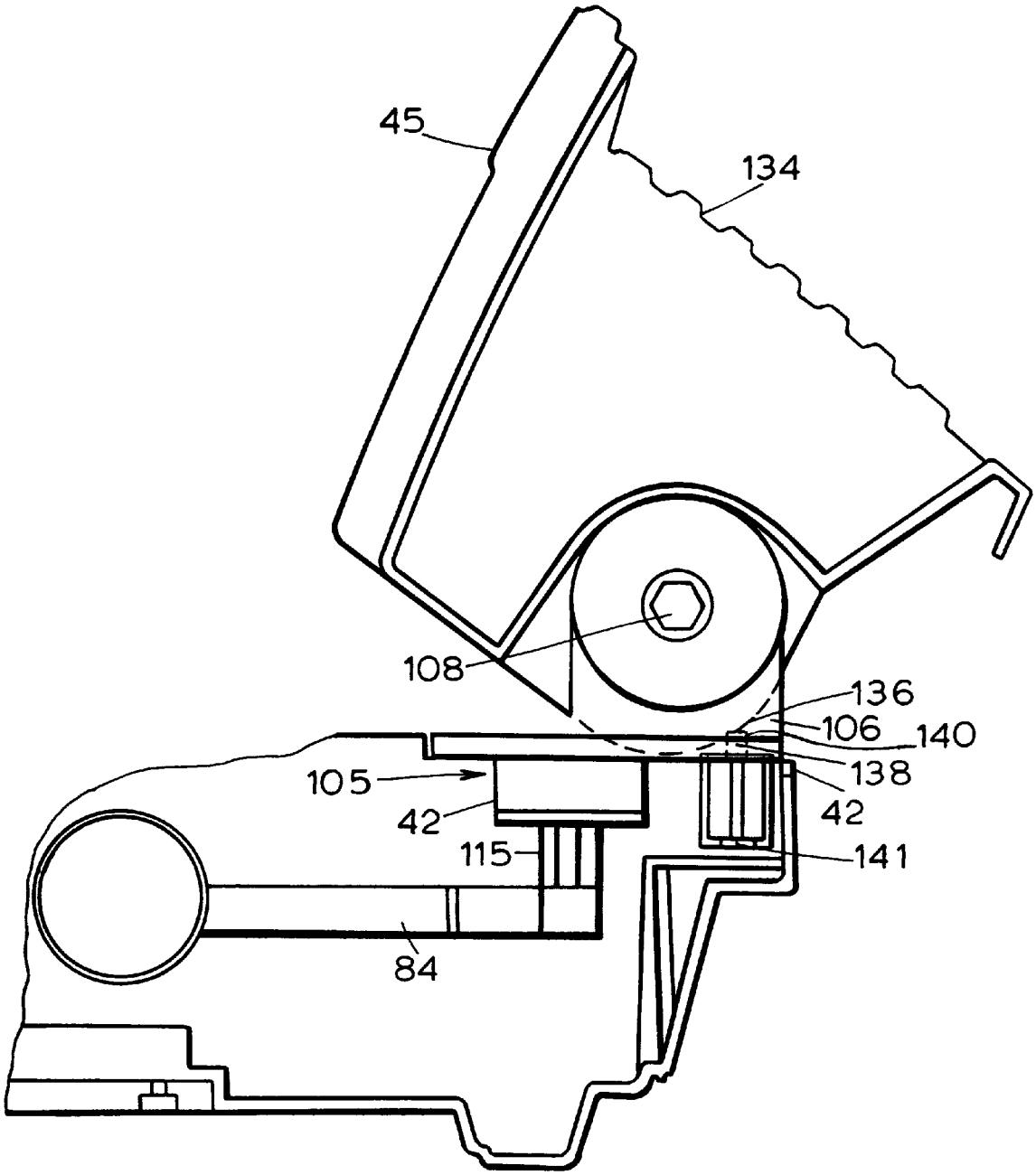
FIG. 6A is section view of the toy truck of FIG. 1 as viewed along lines 6A—6A shown in FIG. 3. Note that the truck bed is shown in side view and the truck bed assembly is shown according to the view lines 6A—6A.
Figure 6C:
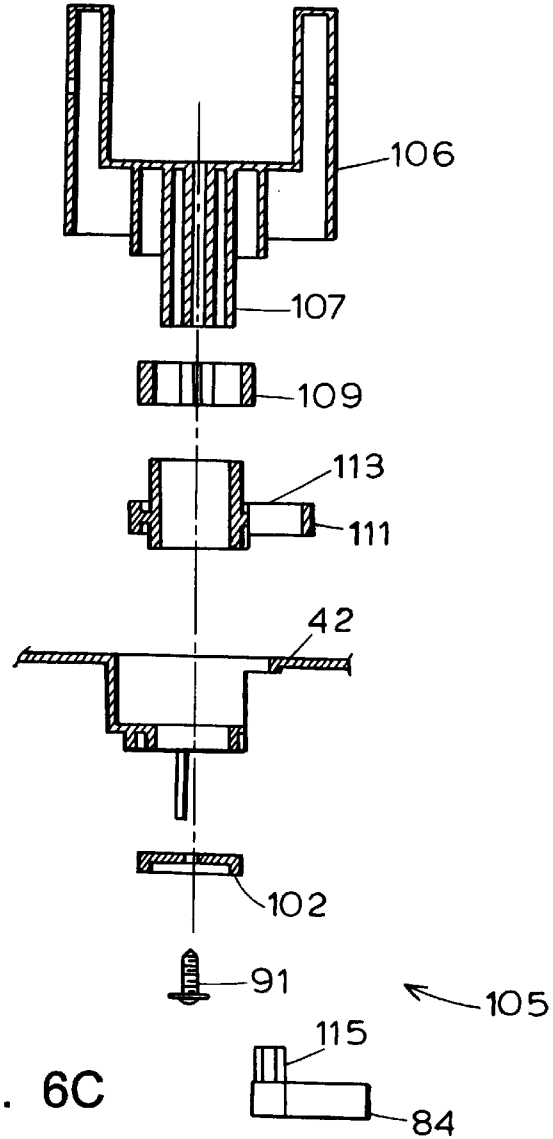
FIG. 6C is an exploded view of FIG. 6B.
Figure 6B:
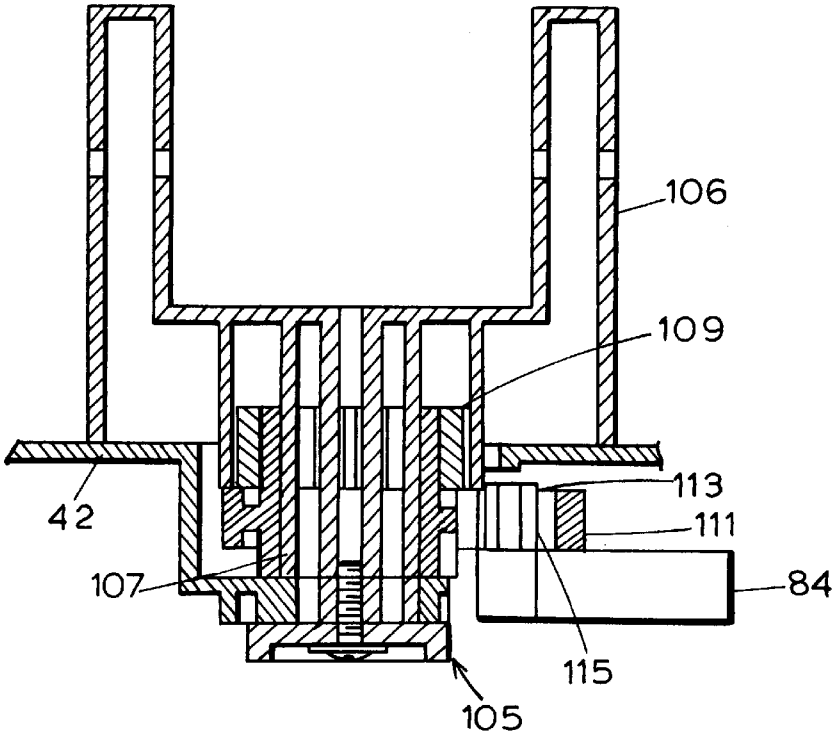
FIG. 6B is a section of the toy truck of FIG. 1 as viewed along lines 6B—6B.

Referring now to FIG. 3, FIG. 5 and to FIG. 6A which illustrates a sectional view of the truck 10 along view lines 6A—6A, the animated feature actuator assembly 47 drives a truck bed assembly 105 to effect the lateral rocking motion of the truck bed 45. Note that FIG. 6A shows the truck bed assembly 105 as viewed along lines 6A—6A whereas the truck bed 45 is viewed as from the side of the toy truck. The truck bed 45 is mounted to the truck bed assembly 105 via a pivot pin 108. Referring also to FIG. 6B, which is a sectional view of the toy truck 10 along view lines 6B—6B and to FIG. 6C which is an exploded view of FIG. 6B, the truck bed assembly 105 includes a carrier 106 having a section 107 that extends through an opening in the upper truck chassis 42. A clutch 109 fits snugly around the section 107 of the carrier 106 and is attached to a clutch arm 111 having a slot 113. A vertical linking element 115 extends vertically from the end of the cam 84 and nests into the slot 113 of the clutch arm 111. A screw 91 fastens a cap 102 to the chassis 42 and bed carrier 106. Thus, cam 84 drives the clutch arm 111 which causes the carrier 106 to rotate in a clock wise and counter-clockwise manner to an angle of 15 degrees off-set from an at-rest center position thereby causing the truck bed 45 to move from side to side as shown in FIG. 5.

During normal operation, when the cam 84 drives the clutch arm 111, the clutch 109 engages such that the rotation of the clutch arm 111 also effects movement of the truck bed 45. In the event that the truck bed 45 is held firmly in place during the bed rocking cycle, the clutch 109 slips such that rotation of the clutch arm 111 does not cause rotation of the carrier 106 and truck bed 45 thereby preventing internal breakage.

As will be understood by one skilled in the art, any number of gearing configurations may be used to implement the animated feature actuator assembly 47 and the wheel-drive gear assembly 48.

Figure 7A:
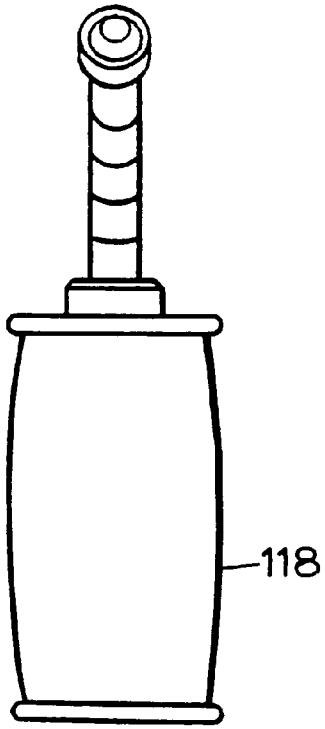
FIGS. 7A and 7B are front and side views, respectively, of a gas can accessory for the toy truck of FIG. 1.
Figure 7B:
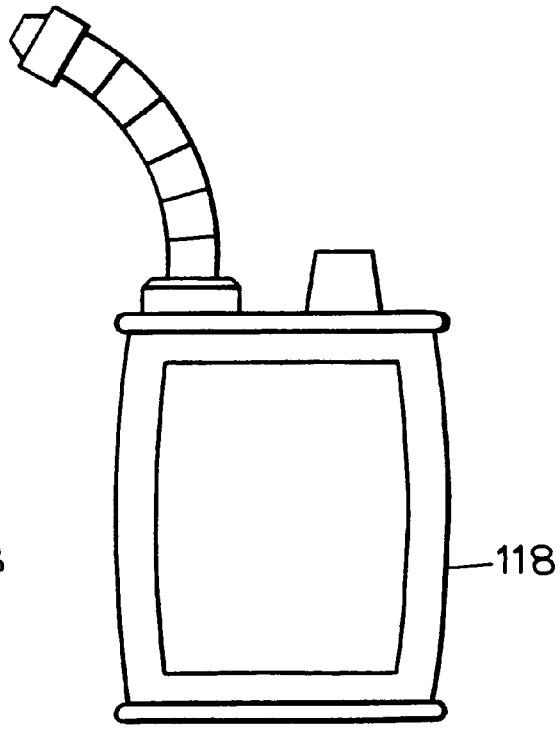

Referring now to FIG. 2 and 3, the toy truck 10 is provided with a number of switches that may be used to actuate the animated feature actuator assembly 47 or may be used to actuate a sound generating device such as a speaker 115 causing it to generate audible phrases or sound effects. For example, a gas tank button 116 disposed between the upper and lower portions of the gas tank 40 may be depressed using an accessory constructed of plastic and having the shape of a gas can 118 (shown in front and side views in FIGS. 7A and 7B). The button 116, when depressed, actuates an elastomeric switch 119 that, in turn, actuates the animated feature actuator assembly 47 and also actuates speaker 115 causing it to generate a phrase. Note that the simultaneous actuation of the animated feature actuator assembly 47 and the speaker 115 causes the mouth 16 to flex while phrases are generated so that it appears as though the toy truck 10 is speaking.

Figure 8:
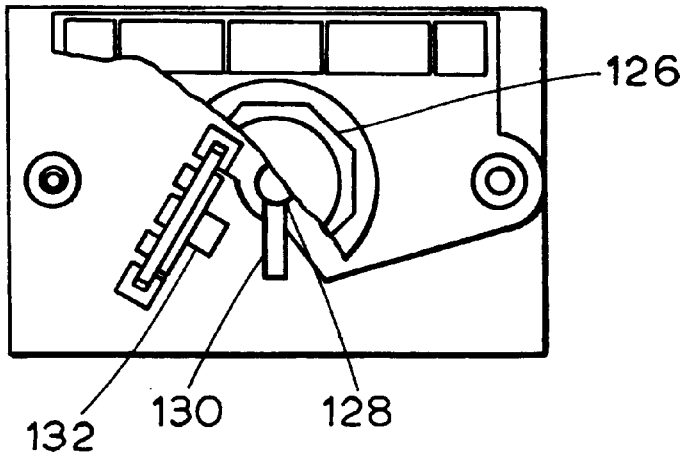
FIG. 8 is a top view of a helmet switch of the toy truck of FIG. 1 shown with a portion of the flexible hood and cab cut away.
Figure 9:
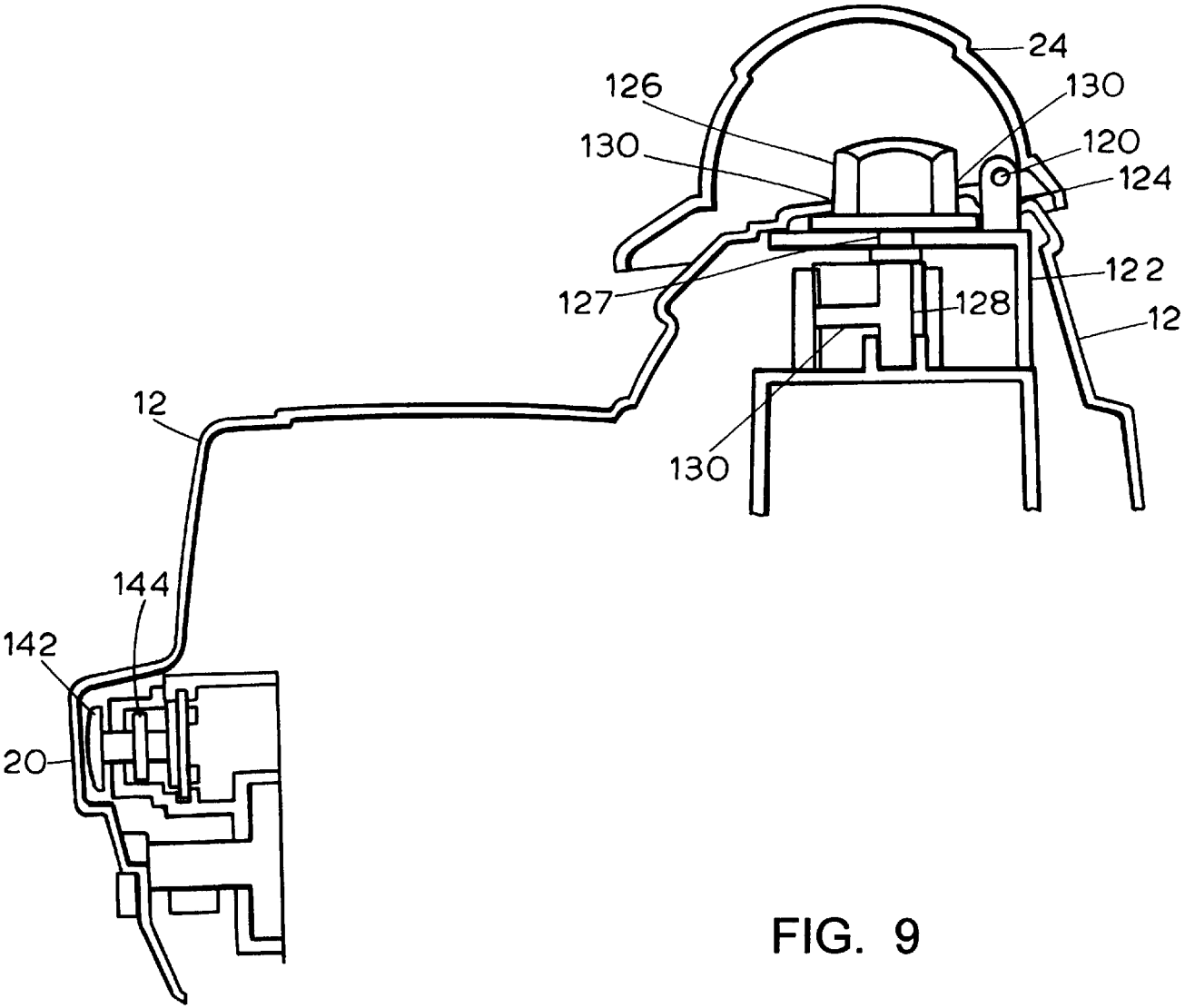
FIG. 9 is a section view of the helmet switch and bumper switch of the toy truck viewed along lines 9—9 as shown in FIG. 5.

Referring now to FIGS. 8 and 9, the helmet 24 is attached to a pivot pin 120 disposed within a support member 122 that extends through a first opening 124 in the flexible hood and cab 12. The helmet 24 pivots around the pivot pin 120 enabling the helmet to be raised in the manner shown in FIG. 2. Referring still to FIGS. 8 and 9, a bolt shaped knob 126 having a stem 128 with a radially positioned actuating element 130 is disposed such that the stem 128 extends through a first opening 127 in support member 122 and the knob protrudes through a second opening 130 in the flexible hood 12. Turning the bolt shaped knob 126 in a clock-wise direction causes the actuating element 130 to move in a clock-wise direction and to contact and depress an elastomeric switch 132. The helmet switch 132, in turn, actuates the animated feature actuator assembly 47 and the speaker 115.

Turning the bolt 126 in a clock-wise direction a second time again actuates the animated feature actuator assembly 47 and causes the speaker 115 to generate a different phrase than the one played in response to a first turn of the bolt 126. As will be appreciated by one skilled in the art, the helmet switch 132 and the gas tank switch 119 may instead cause the speaker 115 to generate any number of sounds including, for example, a siren sound or the sound of a truck motor.

Referring again to FIG. 6A, the truck bed 45 is configured such that it has three sides that form a cavity 134 within which objects may be placed. The truck bed 45 rotates about the pivot pin 108 thereby allowing the truck bed 45 to be manually dumped causing the contents of the bed 45 to be discarded. The rear of the truck bed 45 is molded to include a fin-shaped actuating element 136 that is aligned with a pushbutton switch 138 that protrudes through an opening 140 in the carrier 106. The fin-shaped actuating element 136 is disposed such that, as the truck bed 45 is rotated about pivot pin 108, the fin-like actuating element 136 contacts and depresses the pushbutton switch 138 which, in turn, operates an elastomeric switch 141. The truck bed switch 141 actuates the animated feature actuator assembly 47 and the speaker 115.

Referring now to FIG. 9, a bumper activation button 142 is disposed in a concealed manner beneath the nose 20. When depressed, the bumper activation button 142 engages an elastomeric switch 144. If the toy truck 10 is traveling forward and contacts a wall or other solid object, the nose 20 is depressed and triggers switch 144. Triggering switch 144 causes the motor 52 to rotate in a reverse direction thereby disengaging the wheel-drive gear assembly 48 and causing the toy truck 10 to come to a halt. Thereafter, the speaker 115 is actuated causing it to generate a sound effect. Lastly, the animated feature actuator assembly 47 and speaker 115 are actuated simultaneously.

As will be appreciated by one skilled in the art, the features used to operate switches 119, 132, 141, 144 are illustrative and may instead be implemented using any desired shape or design and further may be located at any number of locations on the truck body 41. In addition, the speaker 115 may be used to generate any number of phrases or sound effects in any desired order.

Figure 10:
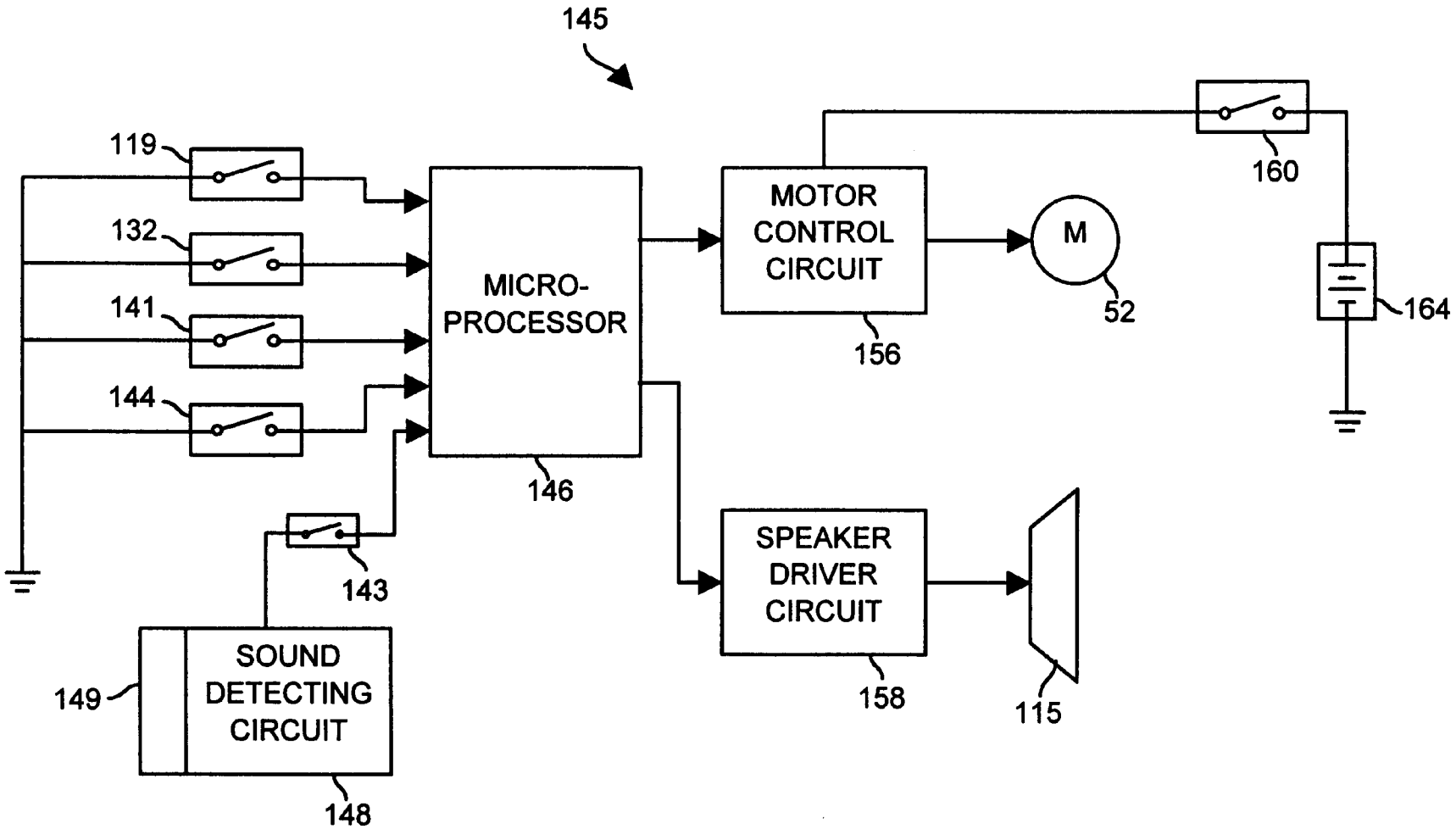
FIG. 10 is a block diagram of a control circuit for the toy truck of FIG. 1.

Referring now to FIG. 10, a control circuit 145 controls a motor control circuit 156 that drives the animated feature actuator assembly 47 and the wheel-drive gear assembly 48 and also controls a speaker driver circuit that drives speaker 115. In particular, control circuit 145 includes a microprocessor 146 that features voice synthesis and control capabilities and that may implemented using, for example, a TI 50C0X chip. The microprocessor 146 is programmed to selectively drive the motor control circuit 156 and the speaker driver circuit 158 in response to actuation signals generated by the switches 119, 132, 141 and 144 and in response to signals generated by a sound detecting circuit 148. The sound detecting circuit 148 includes a microphone 149 and provides an actuating signal to the microprocessor 146 whenever sound that exceeds a threshold decibel level corresponding approximately to the level of sound generated by human speech is detected.

Referring now to FIGS. 3 and 10, the toy is also provided with a power switch 160 that is positioned within a slot 162 in the lower chassis 44 and may occupy either an "on" or "off" position. When the power switch 160 is in the "off" position, the battery is disconnected from the motor and from the microprocessor so that the toy truck 10 is powered down. When power switch 160 is in the "on" position, the motor 52 and microprocessor 146 are powered and the switches 119, 132, 141 and 144 are operable. A voice actuation switch 143 is disposed on the underside of the driver side gas tank 40 and operates as a mode select switch that may be set in one of two positions with each position corresponding to one of two operating modes. In a first mode, the sound detecting circuit 148 is enabled so that the toy will respond to speech signals (and sounds having common decibel levels). In a second mode, the detecting circuit 148 is disabled so that the toy does not respond to voice signals. The switches 119, 132, 141 and 144 are operable in either mode.

The toy truck 10 is battery 164 powered and is provided with a power saving mode whereby if the toy truck 10 is not voice actuated within a predetermined amount of time, the sound detecting circuit 148 becomes disabled.

Figure 11:
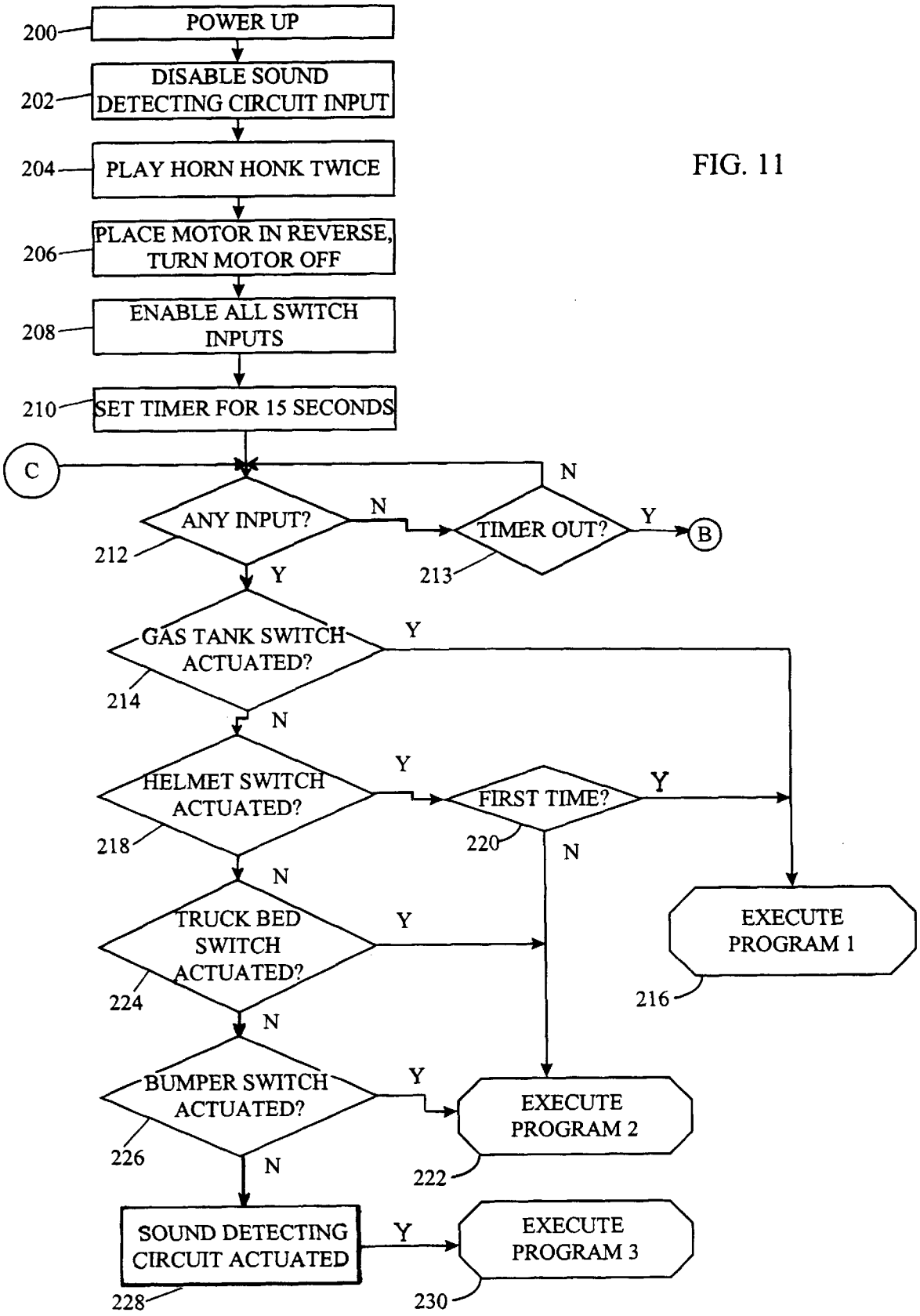
FIGS. 11, 12A, 12B, 13 and 14 depict a flow chart of a computer program that controls the operation of the toy truck of FIG. 1.

Referring now to FIG. 11 which provides a flowchart of the computer program for microprocessor 146, the program begins at a block 200 when the power switch 160 is placed in the "on" position. After power up, control passes to a block 202 where the microprocessor 146 disables the sound detecting circuit 148 input such that the microprocessor 146 will not respond to actuation signals generated by the sound detecting circuit 148. Conversely, if this input is enabled, then the microprocessor 146 will respond to input signals generated by the sound detecting circuit 148. Note that the inputs for each of the switches 119, 132, 141 and 144 are also disabled and/or enabled at various blocks in the computer program.

Next, to alert the child that the toy is powered up, control proceeds to a block 204 where the microprocessor 146 causes the speaker 115 to generate a sound effect of, for example, a couple of horn honks. It will be understood by those skilled in the art that the microprocessor 146 actuates the speaker driver circuit 158 to effect sound generation from the speaker 115. Note that the sound detecting circuit 148 input was disabled at the block 202 to prevent the microprocessor 146 from responding to the false actuation signal that the sound detecting circuit 148 would generate in response to the horn honks if it were not disabled. Control then passes to a block 206 where the microprocessor 146 places the motor 52 in reverse and then turns the motor 52 off. Next, at a block 208, the microprocessor 146 enables all inputs so that it is capable of responding to input generated by any of the switches 119, 132, 141 and 144 and the sound detecting circuit 148. Thereafter, control passes to a block 210 where the microprocessor 146 sets a timer 147 (not shown) that is internal to the microprocessor 146 for fifteen seconds.

Next, the microprocessor 146 tests to determine whether an input signal has been received at a block 212. If an input signal is present, then control passes to a block 214 where the microprocessor 146 determines whether the gas tank switch 119 has been actuated. If the gas tank switch 119 has been actuated, then control proceeds to a block 216. If, instead, the gas tank switch 119 has not been actuated, then control proceeds to a block 218 where the microprocessor 146 determines whether the helmet switch 132 has been actuated. If the helmet switch 132 has been actuated, then control passes to a block 220 where the microprocessor 146 determines whether the helmet switch 132 has been actuated for the first time. If so, then control passes to the block 216. At the block 216, the microprocessor executes a program titled "Program 1."

Figure 12A:
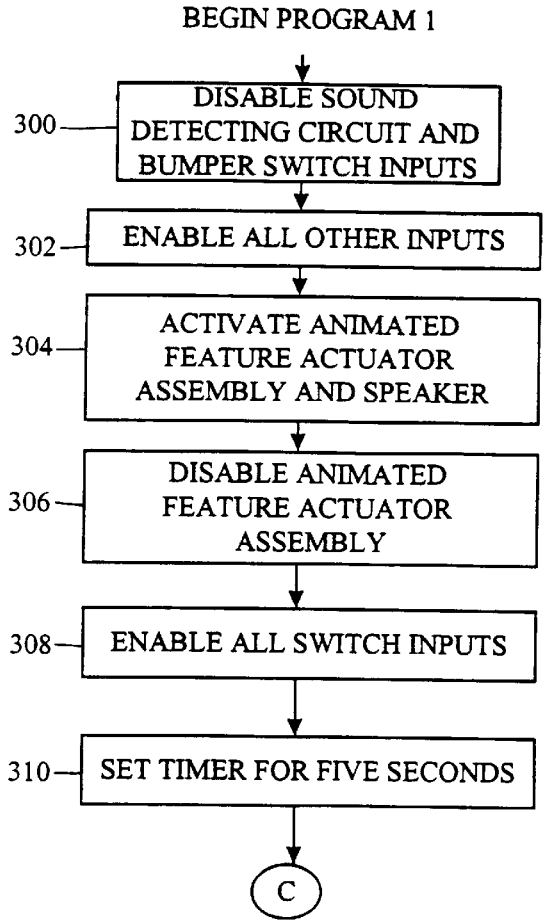

Referring now to FIG. 12A, Program 1, begins at a block 300 where the microprocessor 146 disables the sound detecting circuit 148 and bumper switch 144 inputs such that the microprocessor 146 will not respond to actuation signals generated by either device. Next, the inputs corresponding to the switches 119, 132 and 141 are enabled at a block 302.

Thereafter, control passes to a block 304 where the microprocessor 146 actuates the animated feature actuator assembly 47 by driving the motor 52 in reverse thereby causing the facial features to deform and flex and also causing the truck bed 45 to rock from side to side. At the same time, the microprocessor 146 actuates the speaker 115 causing it to generate a phrase. The phrase generated varies depending upon the switch actuated. For example, if the gas tank switch 119 was actuated, then the speaker 115 generates the phrase, "Swallow, Ahh, thanks buddy that was mighty good." Or, in response to a first turn of the helmet switch 132, the speaker 115 generates the phrase "Tune me up buddy, I'm running' rough today." After the phrase has been generated, the microprocessor 146 deactuates the animated feature actuator assembly 47 at a block 306 and then enables all switch inputs at a block 308. At a last block 310 of Program 1, the microprocessor 146 sets the timer 147 for five seconds.

Referring back to FIG. 11, after block 310, control returns to the block 212 where the microprocessor 146 again determines whether an input signal is present. In the event that an input signal has been received, control returns again to the block 214 where the microprocessor 146 determines whether the gas tank switch 119 has been actuated. If it has not, then control again flows to the block 218 where the microprocessor 146 tests to determine whether the helmet switch 132 has been actuated. If so, then control passes to the block 220 where the microprocessor 146 determines whether the helmet switch 132 is being activated for the first or second time. If the helmet switch 132 is being actuated for the second time, control proceeds to a block 222 where the microprocessor 146 executes a program titled "Program 2." Before describing Program 2, note that, if the result of the test performed at block 218 had been negative indicating that the helmet switch 132 had not been actuated, then control would instead proceed to a set of blocks 224 and 226 where the microprocessor 146 tests for actuation of either the truck bed switch 141 or the bumper switch 144, respectively. In the event that either switch 141 or 144 has been actuated, then control also passes to the block 222 where Program 2 is executed.

Figure 12B:
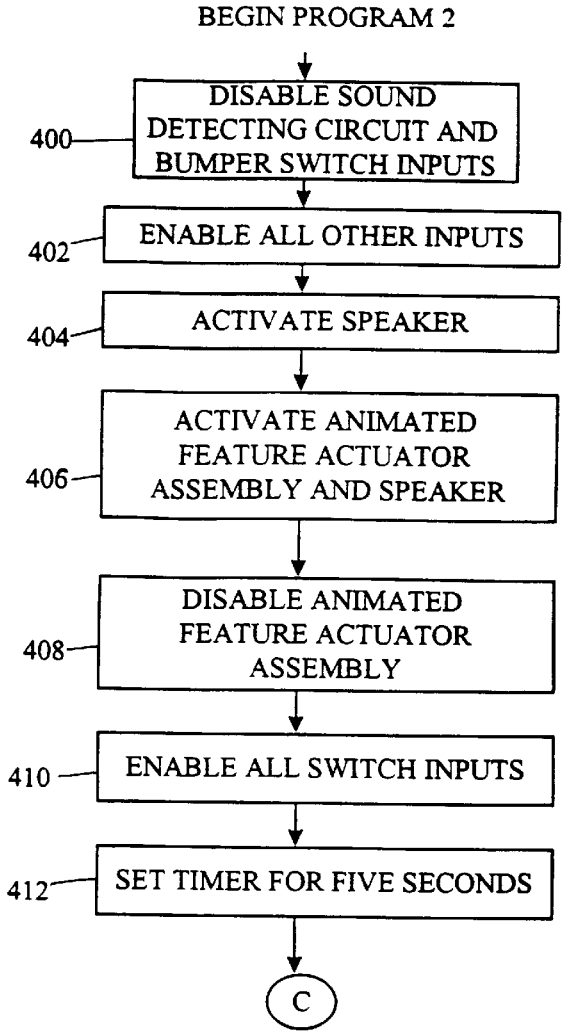

Referring now to FIG. 12B, Program 2 begins at a block 400 where the microprocessor 146 disables the sound detecting circuit 148 and bumper switch 144 inputs. Thereafter, control passes to a block 402 where the microprocessor 146 enables all remaining switch inputs. Next, the microprocessor 146 actuates the speaker 115 causing it to generate a sound effect at a block 404. The sound effect generated varies depending upon the received input signal. For example, if the input signal originated from the bumper switch 144, then the speaker 115 generates the sound effect of a crash. In response to an input signal from the truck bed switch 141, the speaker 115 generates the sound effect of a motorized truck bed lifting and then coming to a halt with a "clunk" or a "thud". Upon a second actuation of the helmet switch 132, the speaker 115 plays the sound effect of an engine sputtering.

After generating the sound effect, control passes to a block 406 where the microprocessor 146 simultaneously actuates the animated feature actuator assembly 47 and the speaker 115. The microprocessor 146 is programmed to generate different phrases in response to different inputs. For example, in response to actuation of the bumper switch 144, the speaker 115 generates the phrase, "Oops, hahaha, let's do that again". In response to an input signal from the truck bed switch 141 the speaker 115 plays, "Great job, let's get another load." Lastly, a second actuation of the helmet switch 132 results in the phrase, "Tune me up buddy, I'm running' rough today".

Next, control passes to a block 408 where the microprocessor 146 deactuates the animated feature actuator assembly 47 and a block 410 where the microprocessor 146 enables all switch inputs. Thereafter, at a block 412, the microprocessor 146 sets the timer 147 for five seconds.

Referring now to FIG. 11, upon completing Program 2, control again returns to the block 212 where the microprocessor 146 determines whether an input signal is present. If an input signal has been received, control again flows through blocks 214, 218, 224 and 226 where the microprocessor 146 determines which switch generated the input signal. In the event that none of the manually operable switches 119, 132, 141 and 148 has generated the signal, then control passes to a block 228 where the microprocessor 146 determines whether the input was received from the sound detecting circuit 148. If so, then control passes to a block 230 where the microprocessor 146 executes the program titled, "Program 3".

Figure 13:
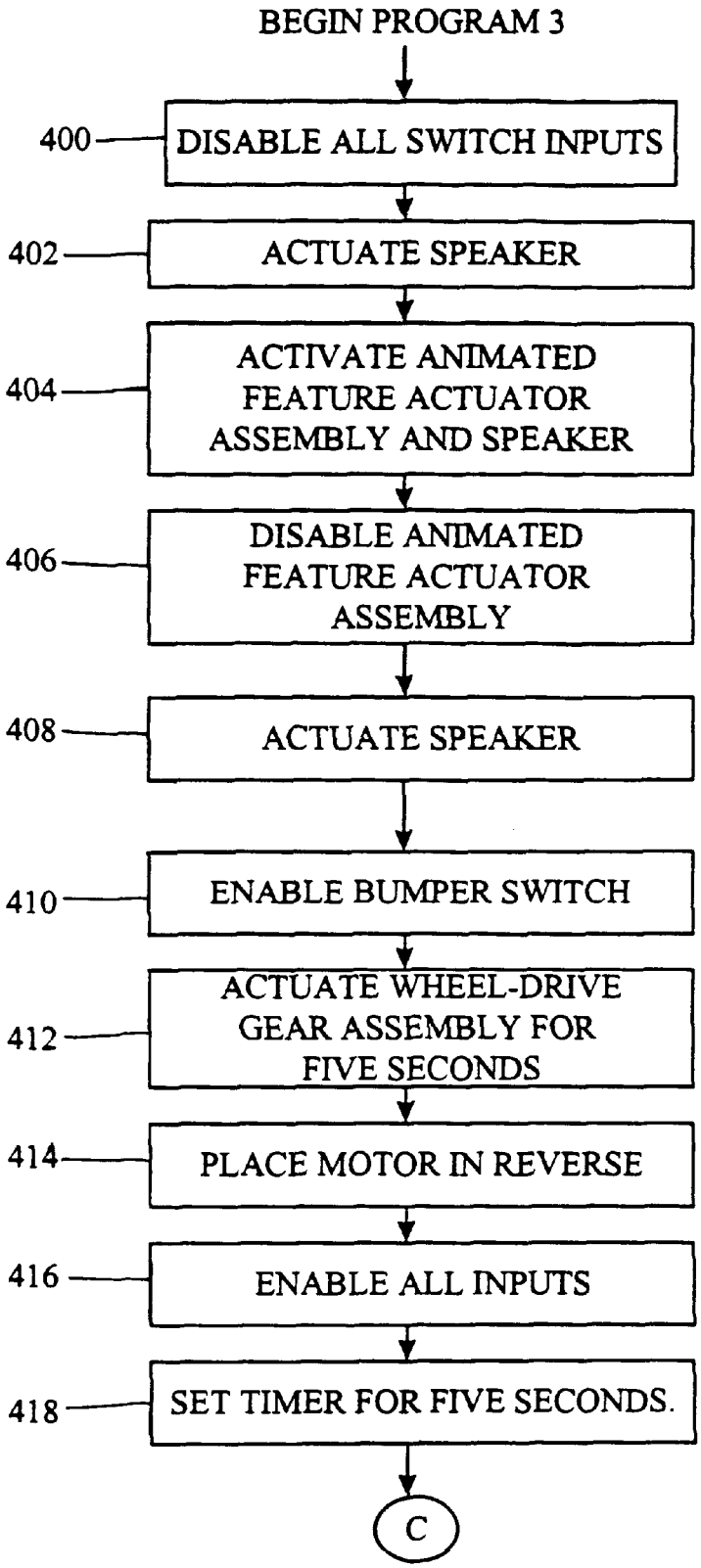

Referring now to FIG. 13, Program 3 begins at a block 400 where the microprocessor 146 disables all switch inputs. Thereafter, at a block 402, the microprocessor 146 actuates the speaker 115 causing it to generate the sound effects of an engine starting and of a horn honking. Next, control proceeds to a block 404 where the microprocessor 146 simultaneously actuates the animated feature actuator assembly 47 and the speaker 115. While the mouth 16 and nose 20 flex and the bed 45 moves from side to side, the speaker 115 generates the phrase, "Let's get rolling', we've got work to do." Then, the microprocessor 146 deactuates the animated feature actuator assembly 47 at a block 406. Next, control passes to a block 408 where the microprocessor 146 actuates the speaker 115 causing it to generate the sound effect of a horn honk. At a block 410, the microprocessor 146 enables the bumper switch 144 input. Thereafter, at a block 412, the microprocessor 146 actuates the wheel-drive gear assembly 48 by driving the motor 52 in a forward direction. The wheel-drive gear assembly 48 operates for five seconds causing the toy truck 10 to travel forward for approximately five feet. Next, at a block 414, the motor 52 is placed in reverse, causing the wheel-drive gear assembly 48 to become disengaged. Finally, at a block 416, the microprocessor 146 enables all inputs and then, at a block 418, sets the timer 147 for five seconds.

Note that due to the step of enabling the bumper switch at the block 410, if during the execution of the steps performed at the blocks 412–416 an input signal is generated by the bumper switch 144 due to the toy truck 10 hitting a wall or other solid object, then control proceeds directly to the block 222 where Program 2 is executed.

Referring now to FIG. 11, after Program 3 has executed, control returns to the block 212 where the microprocessor 146 again tests for the presence of an input signal as previously described. If no input is received at the block 212 then the microprocessor 146 determines whether the timer 147 has expired at a block 213.

Figure 14:
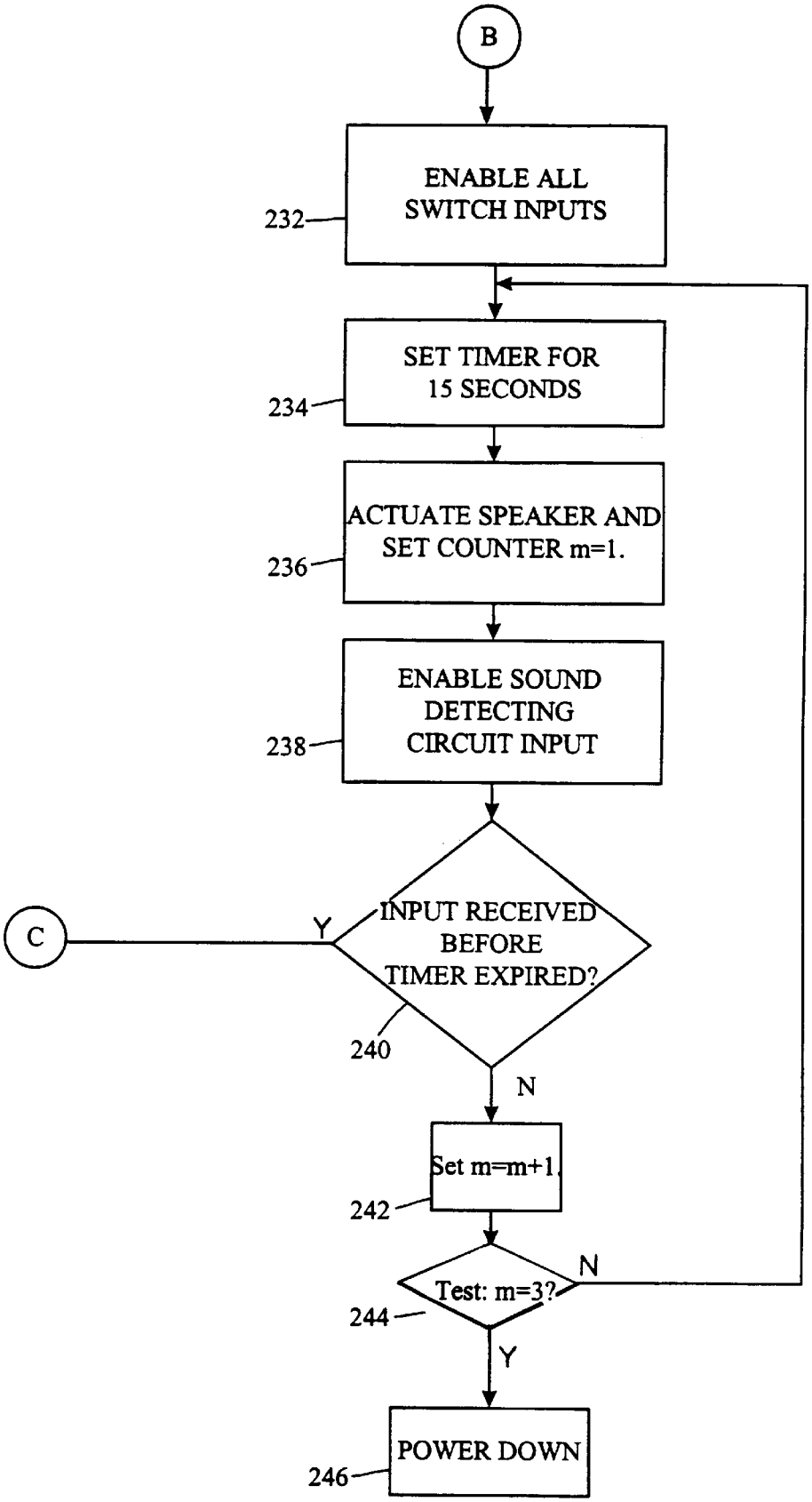

Referring now to FIG. 14, if the timer 147 has expired, then control is passed to a block 232 where the microprocessor 146 enables all switch inputs. Next, the microprocessor 146 sets the timer 147 for fifteen seconds at a block 234. Then control proceeds to a block 236 where the microprocessor 146 causes the speaker 115 to generate the sound effect of a horn honk to remind the child that the toy truck 10 is in a powered state and also to urge the child for input. After, the sound effect is played, the microprocessor 146 sets a counter m equal to zero(m=0). Next, control passes to a block 238 where the microprocessor 146 enables the sound detecting circuit 148 input.

Thereafter, control passes to a block 240 where the microprocessor 146, before expiration of the timer 147, determines whether an input signal is present. If an input signal is detected prior to expiration of the timer 147, then control passes to the block 212 (see FIG. 11) where the microprocessor 146 reiterates the steps performed at the blocks 214, 218, 224 and 228, (see FIG. 11) or, depending on the source of the input signal, a subset thereof. Once the source of the input is known, control proceeds in the sequence previously described for each of the switches 119, 132, 141 and 148.

Referring still to FIG. 14, if an input signal is not detected before the timer 147 expires, then control proceeds to a block 242 where the counter m is incremented by one (m=m+1). Next, the microprocessor 146 tests for the condition m=3 at a block 244. If the condition m=3 is not satisfied, then control returns to the block 234 and control continues thereafter in the sequence previously described. If, instead, the condition m=3 is satisfied thereby indicating that the toy has prompted the child for input three times without response, then control passes to a block 246 where the toy truck 10 is placed in a sleep mode to conserve battery power. While in the sleep mode, sound detecting circuit 148 is disabled such that the microprocessor 146 will not respond to signals generated by the sound detecting circuit 148. The microprocessor 146 will, however, respond to actuation of the switches 119, 132, 141 and 148. In addition, actuation of any of the switches 119, 132, 141 and 148 during the sleep mode causes the sound detecting circuit 148 input to become enabled such that the microprocessor 146 will again respond to actuation signals provided by the circuit 148.

Note that if any of the manually operable switches 119, 132, 141 and 148 are operated during the sleep mode then, depending upon which of the switches is operated, programming returns to the corresponding block 214, 218, 224 or 226. In addition, if the sound detecting circuit switch 143 is in the off position, then the microprocessor will not receive and thus, will not respond to signals generated by the sound detecting circuit 148.

Note that, after execution of the Programs 1, 2 and 3, the motor is positioned to drive the animated feature actuator assembly such that the wheel drive assembly is not engaged so that the wheels are in a free-wheeling mode allowing the child to manually roll the toy truck 10 forward and backward.

The sequence of voice actuated events, in conjunction with the animated features provide the toy truck 10 with an animated personality thereby enhancing the quality of the experience of playing with the toy. As will be understood by one skilled in the art the sequence of voice actuated events may include any combination of the features performed in any order. Further, the phrases and sound effects generated may be varied in any desired manner.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A voice activated toy truck comprising:

a truck chassis;

a hood supported by said truck chassis, said hood being composed of a flexible material so that said hood can readily bend;

a truck bed supported by said truck chassis;

a truck bed carrier mounting said truck bed to said truck chassis so that said truck bed is movable relative to said truck chassis in a side-to-side fashion;

four wheels associated with said truck chassis;

a first actuator assembly associated with said chassis, said first actuator assembly being adapted to selectively cause said flexible hood to bend;

a second actuator assembly associated with said chassis, said second actuator assembly being adapted to selectively cause said truck bed to move in said side-to-side fashion;

a sound detecting circuit associated with said chassis, said sound detecting circuit being adapted to detect sound; and a control circuit operatively coupled to said first actuator assembly and said second actuator assembly and said sound detecting circuit, said control circuit being adapted to cause said first actuator assembly to cause said flexible hood to bend in response to said sound detecting circuit detecting sound and said control circuit being adapted to cause said second actuator assembly to cause said bed to move in said side-to-side fashion in response to said sound detecting circuit detecting said sound.

2. The voice activated toy truck according to claim 1 wherein said flexible hood has an exterior surface and wherein said exterior surface is molded to have the shape of facial features such that when said actuator assembly causes said hood to bend said actuator assembly also causes said facial features to flex.

3. The voice activated toy truck according to claim 1 additionally comprising a sound generating device adapted to generate a set of predetermined phrases and sound effects in response to said sound detecting circuit detecting sound.

4. The voice activated toy truck according to claim 1 wherein said control circuit comprises a microprocessor having voice synthesis capabilities.

5. The voice activated toy truck according to claim 2 additionally comprising a sound generating device adapted to generate a set of predetermined phrases and sound effects in response to said sound detecting circuit detecting sound and wherein said control circuit is adapted to simultaneously cause said first actuator assembly to cause said facial features to flex and to cause said sound generating device to generate said predetermined phrases and sound effects thereby causing said toy truck to appear to be speaking.

6. The voice activated toy truck according to claim 3 wherein said sound generating device comprises a speaker.

7. The voice activated toy truck according to claim 1 additionally comprising a plurality of switches disposed at various locations about said truck chassis, wherein said control circuit is adapted to cause said first actuator assembly to cause said flexible hood to bend in response to actuation of one of said switches and wherein said control circuit is adapted to cause said second actuator assembly to cause said truck bed to move in said side to side fashion in response to actuation of one of said switches.

8. The voice activated toy truck according to claim 7 additionally comprising:

a first opening in said flexible hood;

a support member mounted to said truck chassis and disposed between said truck chassis and said flexible hood;

a portion of said support member extending through said first opening in said flexible hood;

a pivot pin;

a helmet mounted to said portion of said support member that extends through said first opening in said flexible hood with said pivot pin in a manner that enables said helmet to pivot about said pivot pin; and wherein one of said switches is mounted to said support member, extends through said first opening in said flexible hood, and is disposed relative to said helmet in a manner such that when said helmet pivots, said one of said switches is revealed.

9. The voice activated toy truck according to claim 7 wherein at least one of said plurality of switches comprises a push-button switch mounted on said chassis, said push-button switch being located in a concealed manner beneath a portion of said flexible hood, wherein said push-button switch is actuated by depressing said portion of said flexible hood.

10. A voice activated toy truck comprising:

a truck chassis;

a movable structure associated with said truck chassis adapted to generate an animated response;

an actuator assembly operatively coupled to said chassis, said actuator assembly being adapted to activate said movable structure adapted to generate an animated response;

a sound detecting circuit associated with said chassis, said sound detecting circuit being adapted to detect sound; and a control circuit operatively coupled to said actuator assembly and said sound detecting circuit, said control circuit being adapted to cause said actuator assembly to activate said movable structure adapted to generate an animated response in response to sound detected by said sound detecting circuit.

11. The voice activated toy truck according to claim 10 wherein said movable structure adapted to generate an animated response comprises:

a hood supported by said truck chassis, said hood being composed of a flexible material so that said hood can readily bend;

a first actuator assembly associated with said chassis, said first actuator assembly being adapted to selectively cause said flexible hood to bend.

12. The voice activated toy truck according to claim 10 wherein said movable structure adapted to generate an animated response comprises:

a truck bed carrier mounting said truck bed to said truck chassis so that said truck bed is movable relative to said truck chassis in a side-to-side fashion;

a second actuator assembly associated with said chassis, said second actuator assembly being adapted to selectively cause said truck bed to move in said side-to-side fashion.

13. The voice activated toy truck according to claim 10 wherein said movable structure adapted to generate an animated response comprises a first movable structure adapted to generate a first animated response and wherein said toy truck additionally comprises a second movable structure adapted to generate a second animated response.

14. A voice activated toy truck comprising:

a truck chassis;

a hood supported by said truck chassis, said hood being composed of a flexible material so that said hood can readily bend;

an actuator assembly adapted to selectively cause said flexible hood to bend;

a sound detecting circuit adapted to detect sound; and a control circuit operatively coupled to said actuator assembly and said detecting circuit, said control circuit being adapted to cause said actuator assembly to cause said flexible hood to bend in response to said sound detecting circuit detecting sound.

15. The voice activated toy according to claim 14 wherein said flexible hood has an exterior surface and wherein said exterior surface is molded in the shape of a set of facial features such that when said actuator assembly causes said flexible hood to bend said actuator assembly also causes said said facial features to flex.

16. The voice activated toy according to claim 15 additionally comprising a sound generating device wherein said control circuit is adapted to cause said sound generating device to generate a set of predetermined phrases and sound effects in response to said sound detecting circuit detecting sound while said control circuit simultaneously causes said actuator assembly to cause said facial features to flex thereby causing the toy truck to appear to be speaking.

17. The voice activated toy according to claim 14 additionally comprising a sound generating device wherein said control circuit is adapted to cause said sound generating device to generate a set of predetermined phrases and sound effects in response to said sound detecting circuit detecting sound.

18. A voice activated toy truck comprising:

a chassis;

a truck bed supported by said truck chassis;

a truck bed carrier mounting said truck bed to said truck chassis so that said truck bed is movable relative to said truck chassis in a side-to-side fashion;

an actuator assembly adapted to selectively cause said bed to move in said side-to-side fashion;

a sound detecting circuit adapted to detect sound; and a control circuit operatively coupled to said actuator assembly and said detecting circuit, said control circuit being adapted to cause said actuator assembly to cause said bed to move in said side-to-side fashion in response to said sound detecting circuit detecting sound.

19. The voice activated toy according to claim 18 additionally comprising a sound generating device wherein said control circuit is adapted to cause said sound generating device to generate a set of predetermined phrases and sound effects in response to said sound detecting circuit detecting sound.

* * * * *